US008760247B2

(12) United States Patent
Isozaki et al.

(10) Patent No.: US 8,760,247 B2
(45) Date of Patent: Jun. 24, 2014

(54) ELECTROMAGNETIC CONTACTOR

(71) Applicants: Masaru Isozaki, Ichihara (JP); Osamu Kashimura, Hino (JP); Hiroyuki Tachikawa, Yokohama (JP); Kouetsu Takaya, Kounosu (JP); Yasuhiro Naka, Kounosu (JP); Yuji Shiba, Kounosu (JP)

(72) Inventors: Masaru Isozaki, Ichihara (JP); Osamu Kashimura, Hino (JP); Hiroyuki Tachikawa, Yokohama (JP); Kouetsu Takaya, Kounosu (JP); Yasuhiro Naka, Kounosu (JP); Yuji Shiba, Kounosu (JP)

(73) Assignees: Fuji Electric Co., Ltd., Kawasaki-shi (JP); Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/664,580

(22) Filed: Oct. 31, 2012

(65) Prior Publication Data

US 2013/0106543 A1 May 2, 2013

(30) Foreign Application Priority Data

Nov. 1, 2011 (JP) ..... 2011-240484

(51) Int. Cl.
*H01H 9/30* (2006.01)

(52) U.S. Cl.
USPC ..... 335/201; 335/131

(58) Field of Classification Search
USPC ..... 335/201
See application file for complete search history.

(56) References Cited

U.S. PATENT DOCUMENTS 5,546,061 A * 8/1996 Okabayashi et al. ..... 335/78
6,768,405 B2 * 7/2004 Nishida et al. ..... 335/177
7,023,306 B2 * 4/2006 Nishida et al. ..... 335/132
7,157,995 B2 * 1/2007 Nishida et al. ..... 335/126
7,286,031 B2 * 10/2007 Nishida et al. ..... 335/132
7,852,178 B2 * 12/2010 Bush et al. ..... 335/126
7,859,373 B2 * 12/2010 Yamamoto et al. ..... 335/126
7,911,301 B2 * 3/2011 Yano et al. ..... 335/131
7,948,338 B2 * 5/2011 Niimi et al. ..... 335/126
8,138,863 B2 * 3/2012 Tanaka et al. ..... 335/195
8,138,872 B2 * 3/2012 Yoshihara et al. ..... 335/281
8,179,217 B2 * 5/2012 Kawaguchi et al. ..... 335/80
8,188,818 B2 * 5/2012 Cho et al. ..... 335/126
8,222,980 B2 * 7/2012 Yamagata et al. ..... 335/126
8,390,410 B2 * 3/2013 Kojima et al. ..... 335/201
8,410,878 B1 * 4/2013 Takaya et al. ..... 335/201
2004/0080389 A1 * 4/2004 Nishida et al. ..... 335/132
2005/0146405 A1 * 7/2005 Nishida et al. ..... 335/132
2005/0151606 A1 * 7/2005 Nishida et al. ..... 335/128

(Continued)

FOREIGN PATENT DOCUMENTS

JP 2002-042626 2/2002

*Primary Examiner* — Shawki S Ismail
*Assistant Examiner* — Lisa Homza
(74) *Attorney, Agent, or Firm* — Manabu Kanesaka

(57) ABSTRACT

An electromagnetic contactor has a contact device including a contact housing for housing a pair of fixed contact pieces and a movable contact piece disposed to contact with and separate away from the pair of fixed contact pieces, a pair of arc-extinguishing inner permanent magnets disposed on inner peripheral surfaces of the contact housing, and a pair of arc-extinguishing outer permanent magnets disposed on outer peripheral surfaces of the contact housing at a section facing the arc-extinguishing inner permanent magnets. Magnetic pole surfaces of the arc-extinguishing inner permanent magnets are arranged in a close vicinity of the movable contact piece and are magnetized to have the same polarity facing each other. The arc-extinguishing outer permanent magnets are magnetized in the same direction as the arc-extinguishing inner permanent magnets disposed nearby and coercive force of the arc-extinguishing outer permanent magnets is greater than of that the arc-extinguishing inner permanent magnets.

6 Claims, 5 Drawing Sheets

(56) References Cited

U.S. PATENT DOCUMENTS

2009/0322454 A1* 12/2009 Tanaka et al. ..... 335/189
2009/0322455 A1* 12/2009 Yoshihara et al. ..... 335/189
2010/0060392 A1* 3/2010 Cho et al. ..... 335/124
2010/0289604 A1* 11/2010 Kojima et al. ..... 335/133
2013/0063232 A1* 3/2013 Takaya et al. ..... 335/201
2013/0127571 A1* 5/2013 Takaya et al. ..... 335/201
2013/0234811 A1* 9/2013 Nishimura ..... 335/189

* cited by examiner

ELECTROMAGNETIC CONTACTOR

CROSS-REFERENCE TO RELATED APPLICATION

This application is based on, and claims priority to, Japanese Patent Application No. 2011-240484, filed on Nov. 1, 2011, contents of which are incorporated herein by reference.

BACKGROUND OF THE INVENTION

1. Field of the Invention

The present invention relates to an electromagnetic contactor containing fixed contact pieces and a movable contact piece in a contact housing.

2. Description of the Related Art

Patent Document 1 discloses a contact device, which is an electromagnetic contactor used in a high voltage DC power supply circuit for electric vehicles and hybrid vehicles. This contact device comprises a contact mechanism that forms an electric path, an electromagnet device that opens and closes the contact mechanism, and a sealed case that houses the contact mechanism and the electromagnet device. At the both sides of the electromagnet device in the direction parallel to the electric path, a partition wall is formed to provide a vent passage between the partition wall and the sealed case. The contact device further comprises a permanent magnet disposed on the inner surface parallel to the electric path of the sealed case, the magnet generating a magnetic field to force an arc developing on the opening process of the contact mechanism toward the vent passage.

Patent Document 1

Japanese Patent No. 3997700

In the conventional example of Patent Document 1, the permanent magnet is disposed near the contact mechanism in the sealed case, thus a small permanent magnet can produce a sufficiently high magnetic flux density at the contact point of the contact mechanism. However, the arc that is extended toward the arc space near the inner surface of the sealed case may experience only a small or even an opposite-direction magnetic field produced by the small magnet. As a result, DC interruption may be impossible or an arc voltage needed for the DC interruption may make the arc space so large that the sealed case becomes an unallowably large scale. To ensure extinguishing the arc, the contact device of Patent Document 1 is provided with a vent passage at the side of the magnet device, and the arc is extended toward the vent passage, which requires a large electromagnet, enlarging the overall device size.

SUMMARY OF THE INVENTION

In view of the above-described problems in the conventional example, an object of the present invention is to provide an electromagnetic contactor employing a contact device that ensures adequate arc-extinguishing performance while having a small arc extinguishing space to reduce the overall size of the contact device.

To achieve the above object, an electromagnetic contactor of the first aspect of the present invention includes a contact device comprising a pair of fixed contact pieces arranged with a predetermined gap therebetween, a movable contact piece disposed freely contacting with and separating away from the pair of fixed contact pieces, and a contact housing made of an insulating material for containing the movable and fixed contact pieces. The contact device further comprises a pair of arc-extinguishing inner permanent magnets and a pair of arc-extinguishing outer permanent magnets. The arc-extinguishing inner permanent magnets are disposed on inner surfaces of the contact housing parallel to a longitudinal direction of the movable contact piece in a close vicinity of the movable contact piece, and magnetized so that magnetic pole faces of the arc-extinguishing inner permanent magnets facing each other are the same type of magnetic pole. The arc-extinguishing outer permanent magnets are disposed on outer surfaces of the contact housing at a location opposing the arc-extinguishing inner permanent magnets, and magnetized so that the direction of magnetization of the arc-extinguishing outer permanent magnets is the same as that of the nearby arc-extinguishing inner permanent magnet and coercive force of the arc-extinguishing outer permanent magnets is greater than that of the arc-extinguishing inner permanent magnets.

When the electromagnetic contactor in this construction is changed to a released state from a closed state in which the movable contact piece contacts with the fixed contact pieces at both sides of the movable contact piece, electric arcs develop between the movable contact piece and the fixed contact pieces. The movable contact piece is interposed between arc-extinguishing inner permanent magnets disposed on inner surfaces of the contact housing facing the movable contact piece in the close vicinity of the movable contact piece. The arc-extinguishing inner permanent magnets are so magnetized that the magnetic pole faces facing each other thereof are the same type of magnetic pole.

In this arrangement of the arc-extinguishing inner permanent magnets opposing each other, the magnetic flux flowing from the N-pole to S-pole of one of the inner permanent magnet and the magnetic flux flowing from the N-pole to S-pole of the other inner permanent magnet both pass, in the direction parallel to the longitudinal direction of the movable contact piece, across the arc-generating place between the movable contact piece and the fixed contact piece. This magnetic flux acts an enough magnitude of Lorentz's force on the arc to extend the arc in the direction perpendicular to the longitudinal direction of the movable contact piece and surely extinguishes the arc. Since the arc-extinguishing inner permanent magnets are disposed facing each other with a relatively small distance, a necessary magnetic flux density is obtained by arc-extinguishing inner permanent magnets with relatively small magnetic force.

Since the arc-extinguishing inner permanent magnets are disposed on the inner surfaces of the contact housing, an appropriately large distance is obtained between the side edge of the movable contact piece and the inner surface of the contact housing to form a necessarily large arc-extinguishing space.

Since an arc-extinguishing outer permanent magnet that is magnetized in the same direction as the arc-extinguishing inner permanent magnet is provided on the outer surface of the contact housing, the magnetic flux from the N-pole to S-pole generated by the inner permanent magnet at the location of longitudinal end of the inner permanent magnet on the inner surface of the contact housing is cancelled by the magnetic flux from the N-pole to S pole of the arc-extinguishing outer permanent magnet. Since the coercive force of the arc-extinguishing outer permanent magnet is greater than that of the arc-extinguishing inner permanent magnet, the magnetic flux density of the magnetic flux from the arc-extinguishing inner permanent magnet across the contact point between the movable contact piece and the fixed contact piece to the arc-extinguishing outer permanent magnet is increased. This magnetic flux generates a Lorentz's force to extend the arc toward the space in the contact housing.

In the electromagnetic contactor of the second aspect of the invention, outer ends, in a direction parallel to the longitudinal direction of the movable contact piece, of each of the arc-extinguishing outer permanent magnets are positioned outer than outer ends, in the direction parallel to the longitudinal direction of the movable contact piece, of the corresponding arc-extinguishing inner permanent magnet.

This configuration ensures that the magnetic flux from the arc-extinguishing inner permanent magnet toward the arc-extinguishing outer permanent magnet passes across the arc-generating place between the movable contact piece and the fixed contact piece.

In an electromagnetic contactor of the third aspect of the present invention, each of the arc-extinguishing outer permanent magnets is divided into two pieces in the longitudinal direction of the movable contact piece.

This construction reduces the total volume of the divided pieces of the arc-extinguishing outer permanent magnets to reduce the magnet cost.

In an electromagnetic contactor of the fourth aspect of the present invention, each of the arc-extinguishing inner permanent magnets is covered with a magnet case of an insulating material formed on the inner surface of the contact housing.

This construction, in which each of the arc-extinguishing inner permanent magnets is covered with a magnet case, prevents any fragments of the arc-extinguishing inner permanent magnets from intervening between the movable contact piece and the fixed contact piece, avoiding inadequate contact between them. In addition, the arc-extinguishing inner permanent magnets can be arranged close to the arc generating places between the movable contact piece and the fixed contact pieces.

In an electromagnetic contactor of the fifth aspect of the present invention, the magnet case has a guide slidably contacting the movable contact piece and restricting rotation of the movable contact piece.

This configuration surely restricts rotation of the movable contact piece with the guide provided on the magnet case of an insulator material covering the arc-extinguishing inner permanent magnet.

In an electromagnetic contactor of the sixth aspect of the present invention, an end region, in the direction parallel to the longitudinal direction of the movable contact piece, of an outer surface of one of the arc-extinguishing outer permanent magnet is connected, by a magnetic yoke, to an end region of an outer surface of the other arc-extinguishing outer permanent magnet, and another end region of the outer surface of the one of the arc-extinguishing outer permanent magnet is connected, by another magnetic yoke, to an end region of the outer surface of the other arc-extinguishing outer permanent magnet.

This construction ensures the generation of Lorentz's force for extending the arc developed between the movable contact piece and the fixed contact piece toward the inner surface of the contact housing.

An electromagnetic contactor according to the present invention comprises a pair of fixed contact pieces and a movable contact piece disposed contacting with and separating away from the pair of fixed contact pieces, and a contact housing for containing the movable and fixed contact pieces. On the inner surface of the contact housing, a pair of arc-extinguishing inner permanent magnets is provided close to the movable contact piece, and on the outer surface of the contact housing, a pair of arc-extinguishing outer permanent magnet is provided. In this construction, a magnetic flux from the N-pole to S-pole at the ends, in the longitudinal direction of the movable contact piece, of the arc-extinguishing inner permanent magnet is cancelled by the magnetic flux from the N-pole to S-pole of the arc-extinguishing outer permanent magnet, and the density of the magnetic flux, in the longitudinal direction of the movable contact piece, can be sufficiently high at the arc-generating places between the movable contact piece and the fixed contact pieces. Thus, the Lorentz's force is surely generated to extend the arc toward the inner surface of the contact housing.

In addition, since the distance between the movable contact piece and the inner surface of the contact housing is at least the thickness dimension of the arc-extinguishing inner permanent magnet, a sufficient room is obtained for an arc-extinguishing space.

BRIEF DESCRIPTION OF DRAWINGS

FIGS. 3A, 3B, and 3C show an insulating cover of the contact device in an electromagnetic contactor according to the present invention, in which FIG. 3A is a perspective view, FIG. 3B is a plan view before combination and FIG. 3C is a plan view after combination.

FIGS. 5A and 5B show another example of contact mechanism, in which FIG. 5A is a sectional view and FIG. 5B is a perspective view.

DETAILED DESCRIPTION OF THE INVENTION

The following describes some preferred embodiments according to the present invention with reference to the accompanied drawings.

Figure 1:
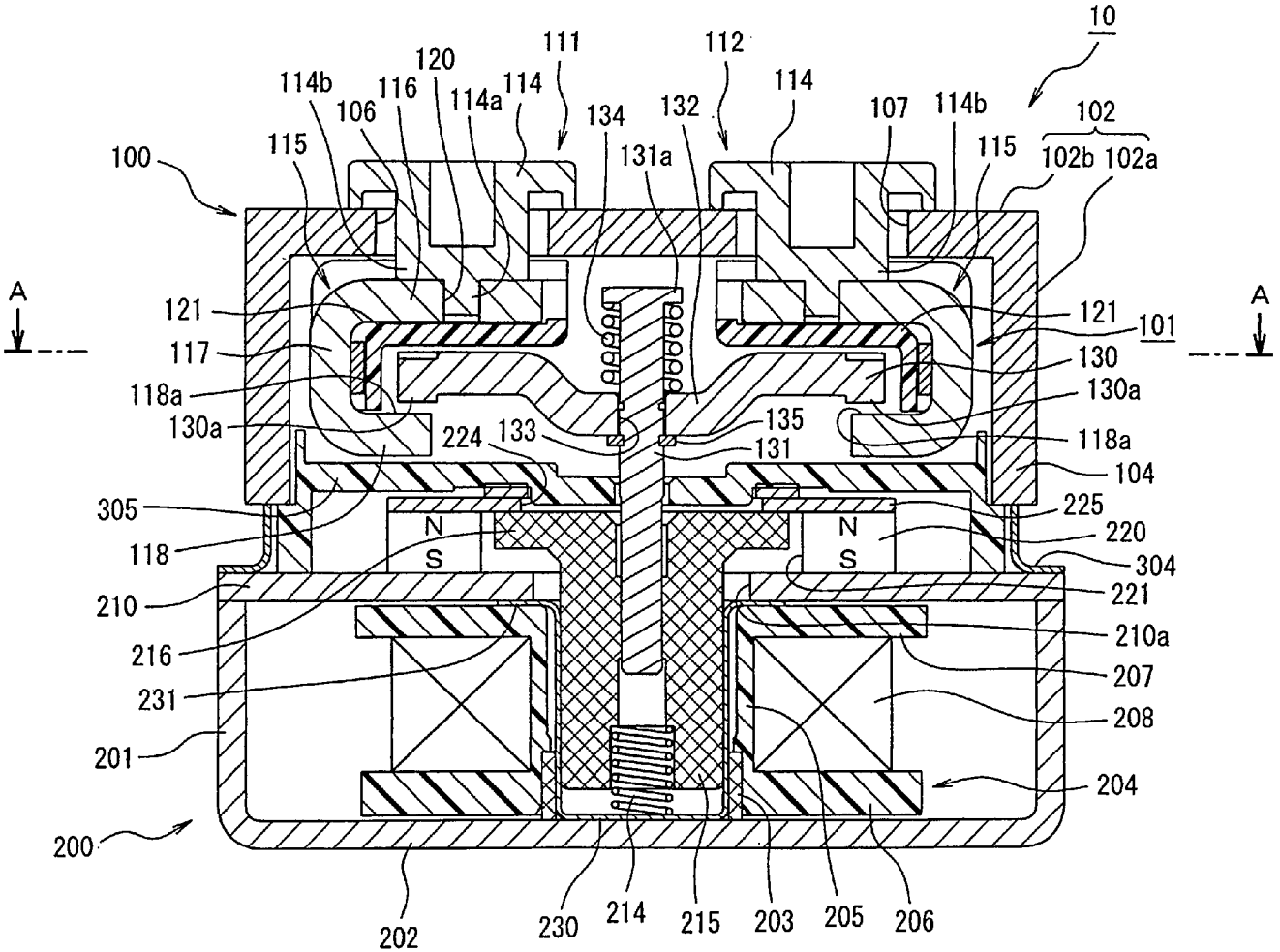
FIG. 1 is a sectional view of an electromagnetic contactor of the first embodiment according to the present invention.
Figure 2A:
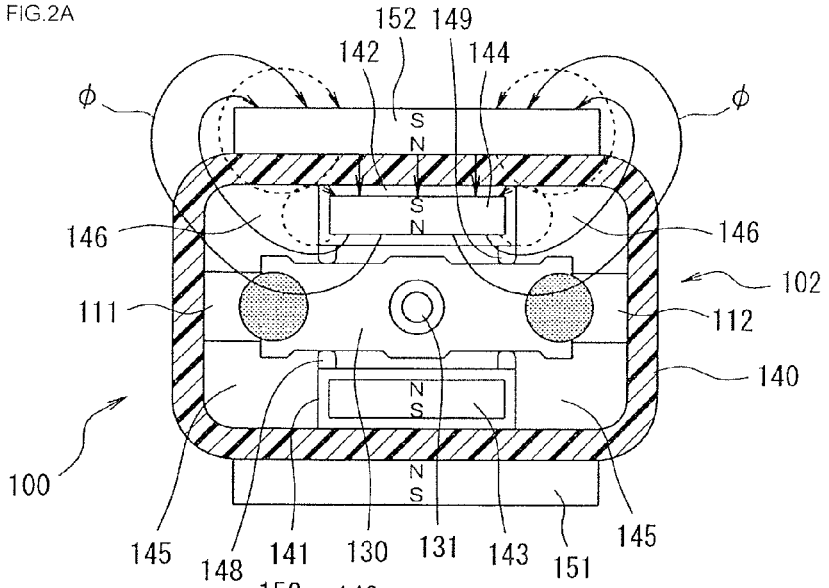
FIGS. 2A, 2B, and 2C are sectional views along the line A-A in FIG. 1.
Figure 2B:
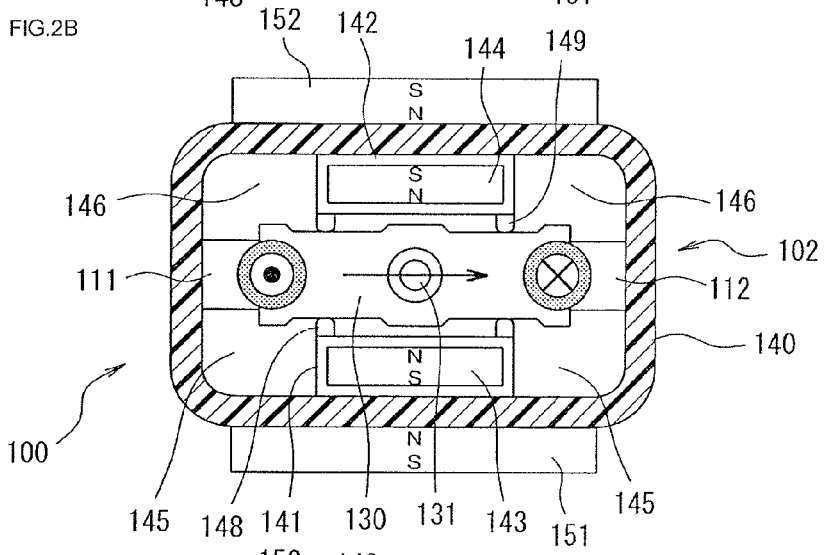
Figure 2C:
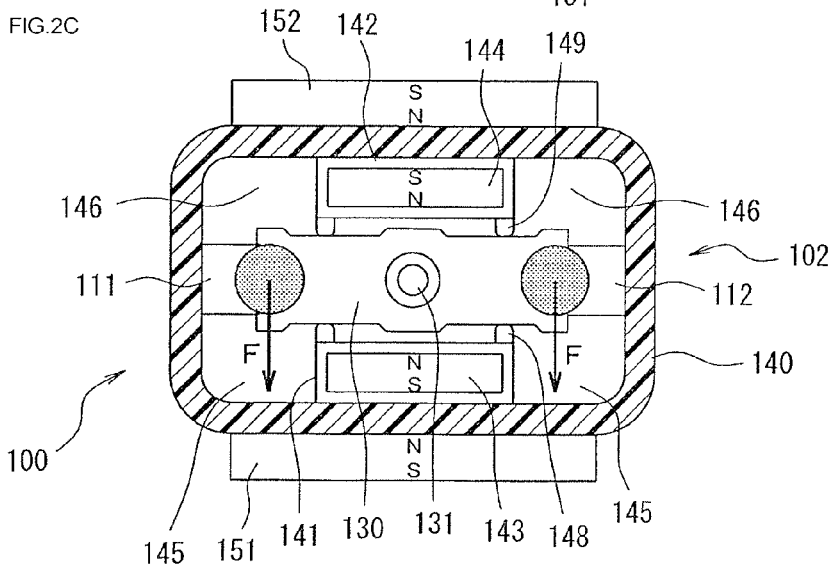

FIG. 1 is a sectional view of an electromagnetic contactor of the first embodiment according to the present invention. FIGS. 2A, 2B, and 2C are sectional views along the line A-A in FIG. 1. The reference numeral 10 in FIG. 1 represents the electromagnetic contactor, which is composed of a contact device 100 and an electromagnet unit 200 disposed under the contact device 100 and provided to drive the contact device 100.

The contact device 100 comprises a contact mechanism 101 and a contact housing 102 containing the contact mechanism 101. The contact housing 102 is formed of ceramics or plastics, for example, and in a shape of a reversed bathtub with an opening at the bottom thereof.

The contact housing 102 formed of ceramics or plastics, for example, has a rectangular tube portion 102*a* and a top plate portion 102*b* closing the top of the rectangular tube portion 102*a* that are molded monolithically together to form a reversed bathtub shape. The bottom opening end side surface of the rectangular tube portion 102*a* is applied with metalizing treatment to form a metal foil, on which a connecting member 304 of metal is seal-joined to complete the contact housing 102. The connecting member 304 of the contact housing 102 is seal-joined to a top magnetic yoke portion 210 of a magnetic yoke 201 as described later.

The contact mechanism 101, as shown in FIG. 1, comprises a pair of fixed contact pieces 111 and 112 that are disposed through through-holes 106 and 107 opened in the top plate portion 102*b* of the contact housing 102 and fixed onto the top plate portion 102*b*. Each of the fixed contact pieces 111 and 112 is composed of a support conductor 114 and a C-shaped part 115. The support conductor 114 has a flange portion 113 at the top thereof protruding out from the through-hole 106 or 107 of the top plate portion 102*b* of the contact housing 102. The C-shaped part 115 with a configuration opening toward inner direction is connected to the support conductor 114 and disposed at the lower surface side of the top plate portion 102*b* of the contact housing 102.

The C-shaped part 115 is composed of a top plate portion 116, an intermediate portion 117, and a bottom plate portion 118, the latter two portions forming an L-shaped part. The top plate portion 116 extends outward along the lower surface of the top plate portion 102*b* of the contact housing 102. The intermediate plate portion 117 extends downward from the outer end of the top plate portion 116. The bottom plate portion 118 extends inward from the bottom end of the intermediate portion 117 in the direction parallel to the top plate portion 116 toward the position where the fixed contact pieces 111 or 112 is facing.

The support conductor 114 and the C-shaped part 115 are joined together by soldering after inserting the pin 114*a* protruding from the bottom of the support conductor 114 into the through-hole 120 formed in the top plate portion 116 of the C-shaped part 115. The support conductor 114 and the C-shaped part 115 can be joined together not only by the soldering but also by simply fitting the two parts, or by forming a male screw on the pin 114*a* and female screw on the through-hole 120 and a screwing the two together.

Figure 3A:
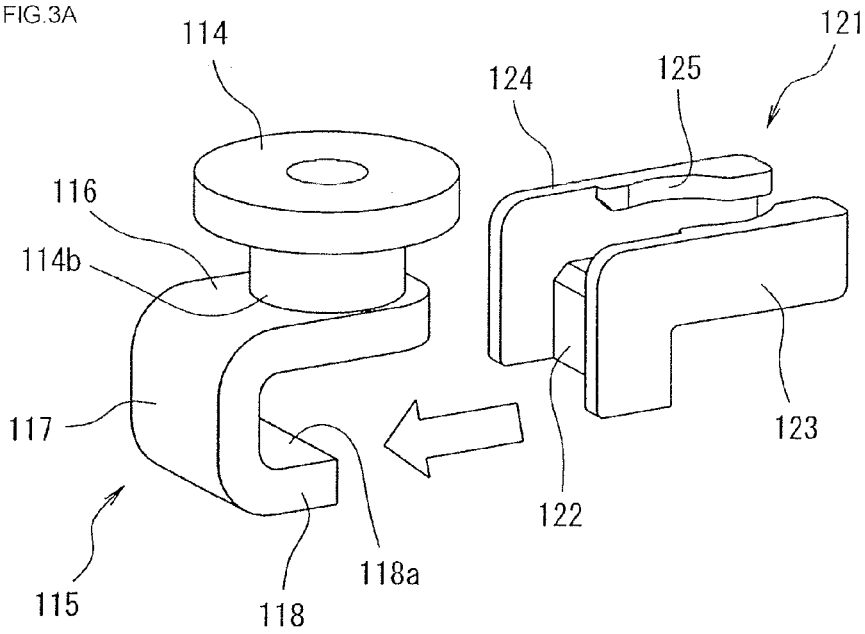
Figure 3B:
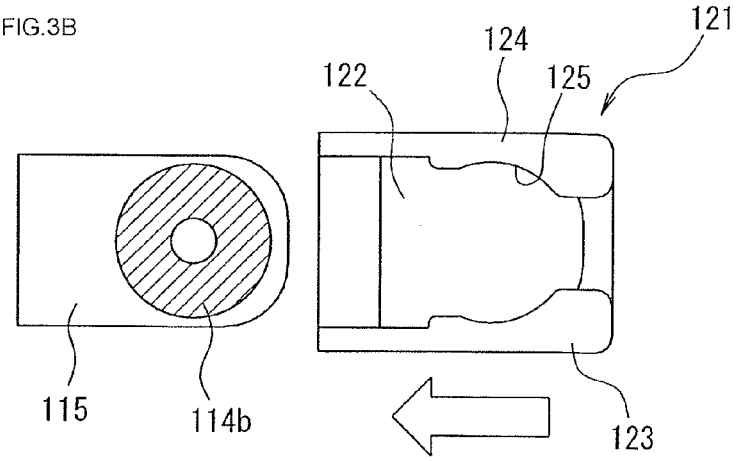
Figure 3C:
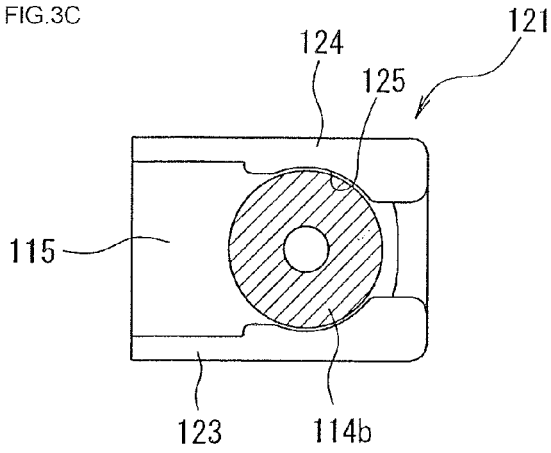

Each of the fixed contact pieces 111 and 112 is provided with an insulating cover 121 made of plastics for restricting extension of arc. The insulating cover 121, as shown in FIGS. 3A, 3B, and 3C, covers the inner surfaces of the top plate portion 116 and the intermediate plate portion 117 of the C-shaped part 115. The insulating cover 121 is comprised of an L-shaped plate portion 122 along the inner surfaces of the top plate portion 116 and the intermediate plate portion 117, side plate portions 123 and 124 extending upward and outward from the front end and the rear end of the L-shaped plate portion 122 and covering the side surfaces of the top plate portion 116 and the intermediate plate portion 117, and an engaging portion 125 formed extending inward from the top end of the side plate portions 123 and 124 and engaging with a smaller diameter portion 114*b* formed on the support conductor 114 of the fixed contact piece 111 or 112.

As shown in FIGS. 3A and 3B, the insulating cover 121 is first positioned with the engaging portion 125 thereof facing the small diameter portion 114*b* of the support conductor 114 of the fixed contact piece 111 or 112. Then as shown in FIG. 3C, the insulating cover 121 is pushed in sideways to engage the engaging portion 125 with the small diameter portion 114*b* of the support conductor 114.

After combining the insulating cover 121 with the C-shaped part 115 of the fixed contact piece 111 (or 112), solely the upper surface of the bottom plate portion 118 is exposed while the inner surface of the other portion of the C-shaped part 115 is covered by the insulating cover 121. The exposed upper surface of the bottom plate portion 118 includes a contact point 118*a*.

A movable contact piece 130 is disposed with the both ends thereof positioned inside the C-shaped parts 115 of the fixed contact pieces 111 and 112. The movable contact piece 130 is supported by a connecting rod 131 fixed to a movable plunger 215 in an electromagnet unit 200, which is described later. As shown in FIG. 1, the movable contact piece 130 has a downwardly recessed portion 132 around the connecting rod 131. The movable contact piece 130 has a through-hole 133 in the recessed portion 132 at the center of the variable contact piece 130. The connecting rod 131 passes through the through-hole 133.

The connecting rod 131 has a flange portion 131*a* at the top thereof. The connecting rod 131 is inserted from the bottom end thereof through a contact spring 134 and then through the through-hole 133 of the movable contact piece 130 until the top end of the contact spring 134 contacts with the flange portion 131*a* of the connecting rod 131. The compression of the contact spring 134 is adjusted to produce an appropriate spring force and positioned with a C-ring 135, for example.

In the opened condition of the contact, the contact points 130*a* at the both ends of the movable contact piece 130 are separated with a predetermined gap from the contact points 118*a* on the bottom plate portion 118 of the C-shaped parts 115 of the fixed contact pieces 111 and 112. In the closed condition of the contact, the contact points 130*a* at the both ends of the movable contact piece 130 are set to contact with the contact points 118*a* on the bottom plate portions 118 of the C-shaped parts 115 of the fixed contact pieces 111 and 112 with a predetermined contact pressure produced by the contact spring 134.

As shown in FIGS. 2A, 2B, and 2C, arc extinguishing inner permanent magnets 143 and 144 are provided that are inserted and fixed through magnet cases 141 and 142 which are formed on the inner surface of the contact housing 102 at the portion facing the side surfaces of the movable contact piece 130.

The arc extinguishing inner permanent magnets 143 and 144 are so magnetized that the magnetic pole faces facing each other in the thickness direction are both N-poles. The both ends in the left and right direction (in the longitudinal direction of the movable contact piece 130) of the arc extinguishing inner permanent magnets 143 and 144 are positioned, as shown in FIGS. 2A, 2B, and 2C, slightly toward the inner side from the position of a contact point 118*a* of the fixed contact piece 111 and a contact point 130*a* of the movable contact piece 130, and the position of a contact point 118*a* of the fixed contact piece 112 and the other contact pint 130*a* of the movable contact piece 130. Arc extinguishing spaces 145 are formed at the both sides of the magnet case 141, and arc extinguishing spaces 146 are formed at the both sides of the magnet case 142.

Movable contact piece guides 148 and 149 for restricting rotation of the movable contact piece 130 are formed protruding at the side ends, in the left and right direction (longitudinal direction of the movable contact piece), of the magnet cases 141 and 142. The guides 148 and 149 are slidably contacting the side edges of the movable contact piece.

Because the arc-extinguishing inner permanent magnets 143 and 144 are disposed on the inside surface of the insulator tube 140 (rectangular tube portion 102*a* of the contact housing 102), the arc-extinguishing inner permanent magnets 143 and 144 can be positioned in close vicinity of the movable contact piece 130.

A pair of arc-extinguishing outer permanent magnets 151 and 152 is provided on the outer surface of the contact housing 102 at the locations facing the arc-extinguishing inner permanent magnets 143 and 144. The arc-extinguishing outer permanent magnets 151 and 152 are magnetized in the same direction as the arc-extinguishing inner permanent magnets 143 and 144, respectively. The arc-extinguishing outer permanent magnets 151 and 152 have greater coercive force than the arc-extinguishing inner permanent magnets 143 and 144. The both ends in the left and right direction, i.e. the longitudinal direction of the movable contact piece 130, of the arc-extinguishing outer permanent magnets 151 and 152 are positioned outer than the location where the contact point 118*a* of the fixed contact piece 111 is facing the contact point 130*a* of the movable contact piece 130 and the location where the contact point 118*a* of the fixed contact piece 112 is facing the other contact point 130*a* of the movable contact piece 130.

In this configuration, the magnetic flux from the N-pole to the S pole near the outer ends in the left and right direction of the arc-extinguishing inner permanent magnets 143 and 144, the magnetic flux being indicated by a dotted curve in FIG. 2A, is partially cancelled by the magnetic flux from the N-pole to the S-pole of the arc-extinguishing outer permanent magnets 151 and 152, this magnetic flux also being indicated by a dotted curve in FIG. 2A. However, the coercive force of the arc-extinguishing outer permanent magnets 151 and 152 is set at larger values than that of the arc-extinguishing inner permanent magnets 143 and 144. As a result, as shown in FIG. 2A, the magnetic flux ϕ with a large magnetic flux density, indicated by solid curves, from the N-pole of the arc-extinguishing inner permanent magnet 143 (or 144) to the S-pole of the arc-extinguishing outer permanent magnets 151 (or 152) passes across the locations of facing contact points 118*a* and 130*a* of the fixed contact pieces 111 and 112 and movable contact piece 130 outwardly in the left and right direction.

When the positive terminal of a current source is connected to the fixed contact piece 111 and a load is connected to the fixed contact piece 112, electric current in the closed condition flows in the path from the fixed contact piece 111, through the movable contact piece 130, to the fixed contact piece 112 as indicated by the arrow shown in FIG. 2B. When the movable contact piece 130 is separated upward from the fixed contact pieces 111 and 112 to change from a closed state to an opened state, electric arc develops between the contact point 118*a* of the fixed contact piece 111 and the contact point 130*a* of the movable contact piece 130 and between the contact point 118*a* of the fixed contact piece 112 and the other contact point 130*a* of the movable contact piece 130.

On these arcs act the Lorentz's forces caused by the magnetic flux ϕ from the N-poles of the arc-extinguishing inner permanent magnets 143 and 144 to the S-poles of the arc-extinguishing outer permanent magnets 151 and 152. The Lorentz's forces are in the direction indicated by the arrow F in FIG. 3C and extend the arcs toward the arc-extinguishing spaces 145. The arc-extinguishing spaces 145 and 146 have a dimension larger than the thickness of the arc-extinguishing inner permanent magnets 143 or 144, which allows an enough arc length to ensure extinguishing the arcs.

The electromagnet unit 200 has a magnetic yoke 201 with a relatively flat U-shape in a side view as shown in FIG. 1. A cylindrical auxiliary yoke 203 is fixed on the center of a bottom plate 202 of the magnetic yoke 201. A spool 204 is disposed outside the cylindrical auxiliary yoke 203.

The spool 204 comprises a central cylinder 205 to which the cylindrical auxiliary yoke 203 is inserted, a bottom flange 206 extending radially outward from the bottom of the central cylinder 205, and a top flange 207 extending radially outward from the top of the central cylinder 205. An exciting coil 208 is wound in the open space formed by the central cylinder 205, the bottom flange 206, and the top flange 207.

A top magnetic yoke portion 210 is fixed between the top of the magnetic yoke 201 in the open end of the magnetic yoke. The top magnetic yoke portion 210 has a through-hole 210*a* at the center thereof facing the central cylinder 205 of the spool 204.

In the central cylinder 205 of the spool 204, a movable plunger 215 is disposed in a vertically slidable condition. A return spring 214 is disposed between the bottom plate portion 202 and a step near the bottom of the movable plunger 215. The movable plunger 215 has a flange portion 216 projecting radially outward at the top of the movable plunger that is sticking out from the top magnetic yoke 210.

On the upper surface of the top magnetic yoke 210 fixed is a permanent magnet 220 with a ring shape surrounding the flange portion 216 of the movable plunger 215. This permanent magnet 220 is magnetized in the vertical direction, or the thickness direction, with an N-pole at the top thereof and an S-pole at the bottom thereof.

On the upper surface of the permanent magnet 220 fixed is an auxiliary yoke 225 that has the same outer diameter as that of the permanent magnet 220 and a through-hole 224 with a diameter smaller than the outer diameter of the flange portion 216 of the movable plunger 215. The flange portion 216 of the movable plunger 215 contacts with the lower surface of the auxiliary yoke 225.

The thickness T of the permanent magnet 220 is set equal to the sum of the stroke L of the movable plunger 215 and the thickness t of the flange portion 216 of the movable plunger 215: T=L+t. Thus, the stroke L of the movable plunger 215 is limited by the thickness T of the permanent magnet 220.

This configuration minimizes the total number of parts and dimensional tolerance that affect the stroke of the movable plunger 215. In addition, since the stroke L of the movable plunger 215 is determined solely by the thickness T of the permanent magnet 220 and the thickness t of the flange portion 216, scattering of the stroke L can be minimized. This is most effective for small electromagnetic contactors with a short stroke in particular.

The permanent magnet 220 can have any external configuration including a square and a ring shape, as long as the inner peripheral surface is a cylindrical shape.

The connecting rod 131 for supporting the movable contact piece 130 is fixed to the center hole of the movable plunger 215 by screwing at the upper location of the plunger.

In the opened state of the contact, the movable plunger 215 is driven upward by the return spring 214 and the upper surface of the flange portion 216 contacts with the lower surface of the auxiliary yoke 225, which is a released position. In this state, the contact point 130*a* of the movable contact piece 130 is separated from the contact point 118*a* of the fixed contact piece 111 and the contact point 118*a* of the fixed contact piece 112, which is a current-interrupted state.

In this released state, the flange portion 216 of the movable plunger 215 is attracted by the magnetic force of the permanent magnet 220 to the auxiliary yoke 225. This attractive force, along with the driving force of the return spring 214, prevents the movable plunger 215 from moving downward due to vibration or other external disturbance, holding the condition of the movable plunger 215 contacting with the auxiliary yoke 225.

The plunger 215 is covered with a cap 230 made of a nonmagnetic material having a cylindrical shape with a bottom portion. The cap 230 has a flange portion 231 extending radially outward from the open end thereof. The flange portion 231 is seal-joined to the lower surface of the top magnetic yoke 210. This configuration forms a hermetically sealed container in which the space inside the contact housing 102 and the space inside the cap 230 are communicating through the through-hole 210*a* in the top magnetic yoke portion 210. The sealed vessel composed of the contact housing 102 and the cap 230 contains arc-extinguishing gas such as hydrogen gas, nitrogen gas, mixed gases of hydrogen and nitrogen, air, SF6, or another gas.

Now, operation of the electromagnetic contactor of the first embodiment is described in the following.

An arrangement is considered in which an externally connecting terminal plate is attached to the fixed contact piece 111, the terminal plate connecting to a power supply for delivering a heavy current, and another externally connecting terminal plate is attached to the other fixed contact piece 112, the terminal plate connecting to a load.

When the exciting coil 208 of the electromagnetic unit 200 is not supplied with electric current, the electromagnetic contactor is in a released state in which the electromagnet unit 200 does not generate a driving force to pull down the movable plunger 215. In this released state, the movable plunger 215 receives a driving force by the return spring 214 upward separating from the top magnetic yoke 210. At the same time, an attractive force produced by the permanent magnet 220 acts through the auxiliary yoke 225 on the flange portion 216 of the movable plunger 215. Thus, the upper surface of the flange portion 216 of the plunger 215 contacts with the lower surface of the auxiliary yoke 225.

In the contact mechanism 101, the contact points 130*a* of the movable contact piece 130, which is connected through the connecting rod 131 to the movable plunger 215, are separated above from the contact points 118*a* on the fixed contact pieces 111 and 112 with a predetermined gap. Thus, the current path between the fixed contact pieces 111 and 112 is in an interrupted state, and the contact mechanism 101 is in an opened state.

In this released state of the electromagnet unit 200, the movable plunger 215 receives both the driving force by the return spring 214 and the attractive force by the ring-shaped permanent magnet 220. Therefore, the movable plunger 215 does not accidentally fall down due to external oscillating force, for example, and any malfunction is avoided certainly.

When an electric current is fed to the exciting coil 208 of the electromagnet unit 200 from his released state, the electromagnet unit 200 generates a magnetic force to push the movable plunger 215 down against the driving force of the return spring 214 and the attractive force of the ring-shaped permanent magnet 220. The downward movement of the movable plunger 215 ceases when the lower surface of the flange portion 216 contacts with the upper surface of the top magnetic yoke 210.

With the downward movement of the movable plunger 215, the movable contact piece 130, which is connected to the movable plunger 215 through the connecting rod 131, also moves down to make the contact points 130*a* of the movable contact piece 130 contact with the contact points 118*a* of the fixed contact pieces 111 and 112 with a contact pressure produced by the contact spring 134.

Thus, a closed state of contact results in which a heavy current I from the external power supply flows through the fixed contact piece 111, the movable contact piece 130, and the fixed contact piece 112.

The fixed contact pieces 111 and 112 each has the C-shaped part 115 composed of the top plate portion 116, the intermediate plate portion 117, and the bottom plate portion 118 as shown in FIG. 1. The bottom plate portion 118 is in a point contact condition with the movable contact piece 130. An electric current flows in the bottom plate portion 118 in the opposite direction to the current flowing in the movable contact piece 130 with respect to the point contact place. As a result, an electromagnetic repulsive force acts in the direction to open the movable contact piece 130.

Because the C-shaped part 115 is formed, however, the current through the top plate portion 116 is opposite to the current through the movable contact piece 130. Consequently, a force to push the movable contact piece 130 onto the contact point 118*a* is generated due to the magnetic field generated by the current through the top plate portion 116 and the magnetic field generated by the current through the movable contact piece 130. Preferably, the C-shaped part 115 is so constructed that the force to push the movable contact piece 130 onto the contact point 118*a* is larger than the electromagnetic repulsive force cause by the point contact in the direction to open the movable contact piece 130. Such a construction is possible, for example, by increasing an overlapping area, in a planar projection, of the top plate portion 116 and the movable contact piece 130, or decreasing a distance between the top plate portion 116 and the movable contact piece 130.

This Lorentz's force acts against the repulsive electromagnetic force that is generated between the contact points 130*a* of the movable contact piece 130 and the contact points 118*a* of the fixed contact pieces 111 and 112, the repulsive electromagnetic force acting in the direction to open the contact. Thus, the Lorentz's force works to surely prevent the contact point 130*a* of the movable contact piece 130 from opening. This reduces the compression force of the contact spring 134 for supporting the movable contact piece 130 and accordingly allows decrease in the thrusting force generated by the exciting coil 208. Therefore, the overall size of the electromagnetic contactor can be reduced.

In order to interrupt the current supply to the load from the closed state of the contact mechanism 101, the current fed to the exciting coil 208 of the electromagnet unit 200 is stopped.

This eliminates the electromagnetic force of the electromagnet unit 200 to drive the movable plunger 215 downward. Consequently, the movable plunger 215 moves upward by the spring force of the return spring 214. As the flange portion 216 approaches the auxiliary yoke 225, the attractive force from the ring-shaped permanent magnet 220 increases.

The upward movement of the movable plunger 215 moves upward the movable contact piece 130, which is connected to the movable plunger 215 through the connecting rod 131. However, in the early stage of the process of upward movement of the connecting rod 131, the movable contact piece 130 remains in contact with the fixed contact pieces 111 and 112 with a contact pressure generated by the contact spring 134. The C-ring 135 moves upward together with the connecting rod 131 until it touches and starts to push the movable contact piece 130 separating the movable contact piece 130 from the fixed contact pieces 111 and 112 overcoming the spring force of the contact spring 134. Thus, transition from the closed state to the opened state of the contact mechanism begins.

When the opening process of the contact mechanism begins, electric arc begins to develop between the contact point 130*a* of the movable contact piece 130 and the contact point 118*a* of the fixed contact piece 111 (or 112). The arc keeps current flow through the contact mechanism. Due to provision of the insulating cover 121 that covers top plate portion 116 and the intermediate plate portion 117 of the C-shaped part 115 of the fixed contact pieces 111 and 112, the arc develops only between the contact point 118*a* of the fixed contact piece 111 (or 112) and the contact point 130*a* of the movable contact piece 130. Therefore, the arc develops stably and arc extinguishing performance is improved.

The magnetic pole faces of the arc-extinguishing inner permanent magnets 143 and 144 facing each other are N-poles and the outside pole faces thereof are S-poles. Similarly, the magnetic pole faces of the arc-extinguishing outer permanent magnets 151 and 152 facing each other are N-poles and the outside pole faces thereof are S-poles. The coercive force of the arc-extinguishing outer permanent magnets 151 and 152 is larger than that of the arc-extinguishing inner permanent magnets 143 and 144.

The magnetic flux ϕ away from the N-pole of the arc-extinguishing inner permanent magnet 144 flows, as shown in FIG. 2A, in the longitudinal direction of the movable contact piece 130 from inside to outside thereof across arc-generating places where contact points 118*a* of the fixed contact pieces 111 and 112 and respective contact points 130*a* of the movable contact piece 130 are facing each other. The magnetic flux ϕ past the arc-generating places returns to the S-pole of the arc-extinguishing outer permanent magnet 152. Similarly, the magnetic flux away from the N-pole of the arc-extinguishing inner permanent magnet 143 flows in the longitudinal direction of the movable contact piece 130 from inside to outside thereof across arc-extinguishing places where contact points 118*a* of the fixed contact pieces 111 and 112 and respective contact points 130*a* of the movable contact piece 130 are facing each other. The magnetic flux ϕ past the arc-generating places returns to the S-pole of the arc-extinguishing outer permanent magnet 151.

After all, both the magnetic flux ϕ from the arc-extinguishing inner permanent magnet 143 and the magnetic flux ϕ from the arc-extinguishing inner permanent magnet 144 pass across the contact place between the contact point 118*a* of the fixed contact piece 111 and the contact point 130*a* of the movable contact piece 130 and across the contact place between the contact point 118*a* of the fixed contact piece 112 and the other contact point 130*a* of the movable contact piece 130. The magnetic flux pass across the contact places in the opposite longitudinal direction of the movable contact piece 130.

The current I flows at the contact place in the side of the fixed contact piece 111 from the contact point 118*a* of the fixed contact piece 111 to the contact point 130*a* of the movable contact piece 130 (from the backside to the front side of the page) as shown in FIG. 2B. The direction of the magnetic flux p is from inside to outside (leftward). According to Fleming's left hand rule, a Lorentz's force F acts to drive the arc toward the arc-extinguishing space 145, as shown in FIG. 2C. The direction of the Lorentz's force is perpendicular to the longitudinal direction of the movable contact piece 130 and perpendicular to the open-close direction (which is perpendicular to the page) between the fixed contact piece 111 and the movable contact piece 130.

The Lorentz's force F extends the arc developed between the contact point 118*a* of the fixed contact piece 111 and the contact point 130*a* of the movable contact piece 130 to a configuration starting from the side face of the contact point 118*a* of the fixed contact piece 111, running in the arc-extinguishing space 145, and arriving at the upper surface of the movable contact piece 130. The arc finally extinguished after such extension.

In the upper and lower parts of the arc-extinguishing space 145, the magnetic flux is inclined upward and downward with respect to the magnetic flux direction at the contact place between the contact point 118*a* of the fixed contact piece 111 and the contact point 130*a* of the movable contact piece 130. The arc extended toward the arc-extinguishing space 145 is further driven by the inclined magnetic flux extending toward corners of the arc-extinguishing space 145 and elongating the arc. Therefore, good interruption performance is achieved.

The current I flows at the contact place in the side of the fixed contact piece 112 from the contact point 130*a* of the movable contact piece 130 to the contact point 118*a* of the fixed contact piece 112 (from the front side to the back side of the page) as shown in FIG. 2B. The direction of the magnetic flux is from inside to outside (rightward). According to Fleming's left hand rule, a Lorentz's force is perpendicular to the longitudinal direction of the movable contact piece 130 and perpendicular to the open-close direction (which is perpendicular to the page) of the fixed contact piece 112 and the movable contact piece 130.

The Lorentz's force extends the arc that is developed between the contact point 118*a* of the fixed contact piece 112 and the contact point 130*a* of the movable contact piece 130 to a configuration starting from the upper surface of the movable contact piece 130, running in the arc-extinguishing space 145, and arriving at the side edge of the contact point 118*a* of the fixed contact piece 112. The arc is finally extinguished after such extension.

In the upper and lower parts of the arc-extinguishing space 145, the magnetic flux is inclined upward and downward with respect to the magnetic flux direction at the contact place between the contact point 118*a* of the fixed contact piece 112 and the contact point 130*a* of the movable contact piece 130. The arc extended toward the arc-extinguishing space 145 is further driven by the inclined magnetic flux extending toward corners of the arc-extinguishing space and elongating the arc. Therefore, an effective interruption performance is achieved.

The magnetic flux generated by the arc-extinguishing inner permanent magnets 143 and 144 at the ends thereof in the direction parallel to the longitudinal direction of the movable contact piece 130, the magnetic flux flowing from the N-pole to the S-pole of the magnets as indicated by the dotted curve in FIG. 2A, is partially cancelled by the magnetic flux generated by the arc-extinguishing outer permanent magnets 151 and 152 at the ends thereof in the direction parallel to the longitudinal direction of the movable contact piece 130, the magnetic flux flowing from the N-pole to the S-pole of the magnets as indicated by the dotted curve in FIG. 2A. Hence, such a magnetic flux component is not generated that could adversely affect arc-extinguishing performance on the extended arcs. Thus, any magnetic flux that might impair arc-driving force in the arc-extinguishing space is prevented from appearing, to ensure good arc-extinguishing performance.

When the electromagnetic contactor 10 is opened from the closed state in which a regenerating current is flowing from the load through the contactor to the DC power supply, the direction of current flow in this case is reversed from the direction indicated in FIG. 2B. Consequently, the Lorentz's force F acts toward the arc-extinguishing space 146 to extend the arc into the arc-extinguishing space 146. Other arc-extinguishing mechanism is similar to the one described in relation to FIGS. 2A, 2B, and 2C.

Since the arc-extinguishing inner permanent magnets 143 and 144 are contained in the magnet cases 141 and 142, respectively, that are disposed on the inner surface of the insulator tube 140 (rectangular tube portion 102*a* of the contact housing 102), the arc does not directly contact with the arc-extinguishing inner permanent magnets 143 and 144. Therefore, the magnetic properties of the arc-extinguishing inner permanent magnets 143 and 144 are stably maintained to achieve stable interruption performance.

In the electromagnetic contactor of the first embodiment described thus far, the arc-extinguishing inner permanent magnets 143 and 144 are disposed on the inner surface of the insulator tube 140 of the contact housing 102, the inner surface facing the side edge of the movable contact piece 130. This disposition locates the arc-extinguishing inner permanent magnets 143 and 144 close to the contact places between the movable contact piece 130 and the fixed contact pieces 111 and 112. This arrangement increases the magnetic flux density directing from inside to outside in the longitudinal direction of the movable contact piece 130. This magnetic flux is necessary to extend the arc into the arc-extinguishing spaces 145 and 146. The increased magnetic flux density results in reduction of magnetic force of the arc-extinguishing inner permanent magnets 143 and 144 for obtaining a necessary magnetic flux density. Thus, the cost of the arc-extinguishing magnets is reduced.

The contact device 100 arranges the C-shaped parts 115 of the fixed contact pieces 111 and 112 and the contact spring 134 for giving contact pressure on the movable contact piece 130 in parallel. This parallel arrangement has a smaller height of the contact mechanism 101 than that of series arrangement of a fixed contact piece, a movable contact piece, and a contact spring. Thus, the contact device 100 of the invention has a small size.

The distance between the side edge of movable contact piece 130 and the inner surface of the insulator tube 140 of the contact housing 102 can be at least a thickness dimension of the arc-extinguishing inner permanent magnets 143 and 144. Therefore, a sufficient size of the arc-extinguishing space can be obtained for the arc to be surely extinguished.

The magnet cases 141 and 142 for containing the arc-extinguishing inner permanent magnets 143 and 144 have guides 148 and 149 for the movable contact piece 130 at the positions facing the movable contact piece 130, the guides slidably contacting with the side edge of the movable contact piece 130. The guides surely prevent the movable contact piece 130 from rotating.

In the magnetic contactor of the first embodiment described above, each of the arc-extinguishing outer permanent magnets 151 and 152 is composed of a single plate of permanent magnet. The arc-extinguishing outer permanent magnets 151 and 152 can each be divided into two plates of permanent magnets at the center position in longitudinal direction of the movable contact piece 130.

Now, an electromagnetic contactor of the second embodiment according to the present invention is described in the following with reference to FIG. 4.

The electromagnetic contactor of the second embodiment is provided with a magnetic yoke outside the arc-extinguishing outer permanent magnets 151 and 152 in the construction of electromagnetic contactor of the first embodiment.

Figure 4:
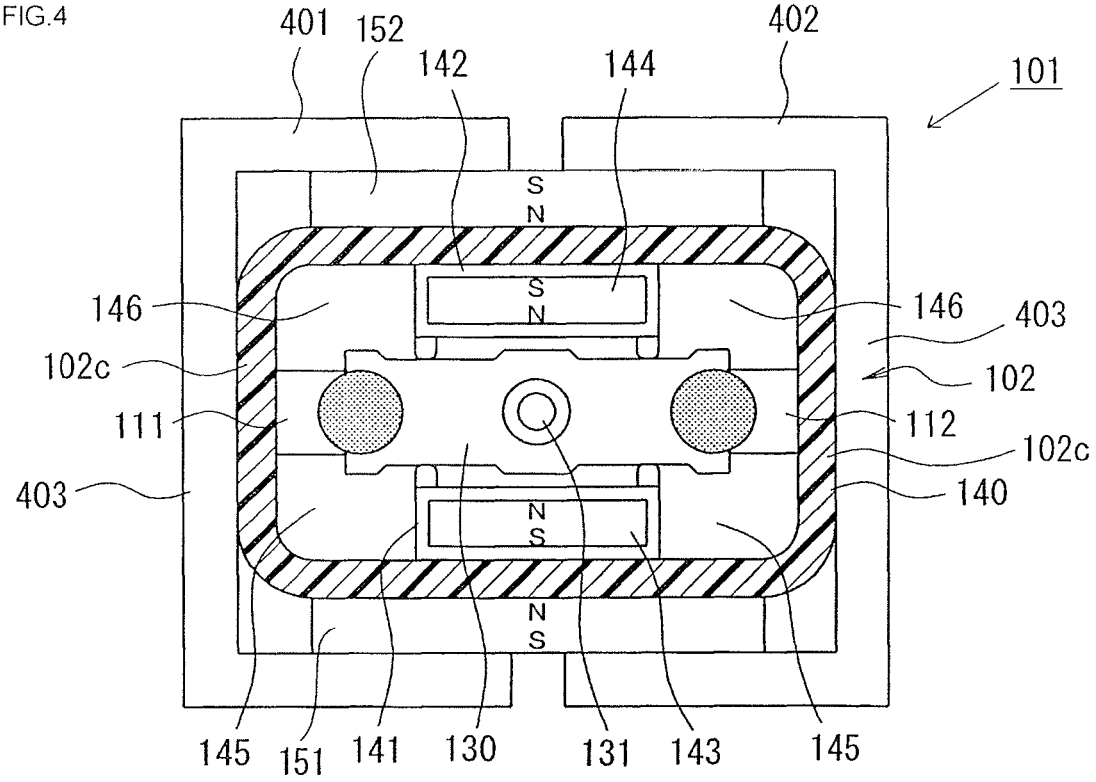
FIG. 4 is a sectional view of the second embodiment according to the present invention, drawn in the condition similar to FIGS. 2A, 2B, and 2C.

In the construction of the contact mechanism 101 of the second embodiment as shown in FIG. 4, the outer surfaces, which are S-poles, of the arc-extinguishing outer permanent magnets 151 and 152 are linked by a pair of magnetic yokes 401 and 402. Other construction is similar to that of the first embodiment.

In FIG. 4, the parts corresponding to those of the first embodiment are given the same symbols as those in FIG. 2 and description for them are omitted.

In the construction of the second embodiment, the arc-extinguishing outer permanent magnets 151 and 152 are magnetically connected by the magnetic yokes 401 and 402 that, each having a configuration of the letter C, are arranged with predetermined gap therebetween at the center position, in the longitudinal direction of the movable contact piece 130, of the outer permanent magnets 151 and 152. The intermediate plate portions 403 of the magnetic yokes 401 and 402 contact with the outer surfaces of the left and right side plate portion 102*c* of the contact housing 102.

In the construction of the second embodiment, the left side half of the S-pole of the arc-extinguishing outer permanent magnet 151 is magnetically connected to the left side half of the S-pole of the arc-extinguishing outer permanent magnet 152 by the left side magnetic yoke 401; similarly the right side half of the S-pole of the outer permanent magnet 151 is magnetically connected to the right side half of the S-pole of the outer permanent magnet 152 by the right side magnetic yoke 402. Consequently, the magnetic flux out of the N-poles, facing the movable contact piece 130, of the arc-extinguishing inner permanent magnets 143 and 144 reaches the intermediate plate portions 403 of the magnetic yokes 401 and 402, and passes through the magnetic paths of the magnetic yokes 401 and 402 to return to the S-poles of the arc-extinguishing outer permanent magnets 151 and 152.

In this construction, the magnetic flux goes out of the N-poles that are insides of the arc-extinguishing inner permanent magnets 143 and 144 and are facing the movable contact piece 130. The magnetic flux passes from inside to outside across the contact place between the contact point 130*a* of the contact piece 130 and the contact point 118*a* of the contact piece 111 (112). The magnetic flux density at the contact places is increased due to the construction having the magnetic yokes 401 and 402 of the second embodiment. The increased magnetic flux density enlarges the Lorentz's force for extending the arc developed between the contact points 118*a* and the contact point 130*a* at the start of current interruption process. Thus, the arc is surely extinguished.

In the construction of the first and second embodiments described above, the magnetic poles facing each other are N-poles in the arrangement of the arc-extinguishing inner permanent magnets 143 and 144 and the arc-extinguishing outer permanent magnets 151 and 152. However, the magnetic poles facing each other can be S-poles in the corresponding arrangement of the inner and outer permanent magnets. This arrangement reverses the direction of the magnetic flux across the arc and the direction of the Lorentz's force, but the same effects as those of the first and second embodiments can be obtained by this reversed configuration.

In the construction of the first and second embodiments described above, the contact housing 102 has a shape of a reversed bathtub. However, the top plate can be a separate member. Another construction is possible in which a contact housing 102 is composed of a rectangular tube body made of metal and a ceramic insulation substrate closing the top of the rectangular tube body. The two members are combined together by brazing and an insulating rectangular tube is provided inside the rectangular tube body of metal.

Figure 5A:
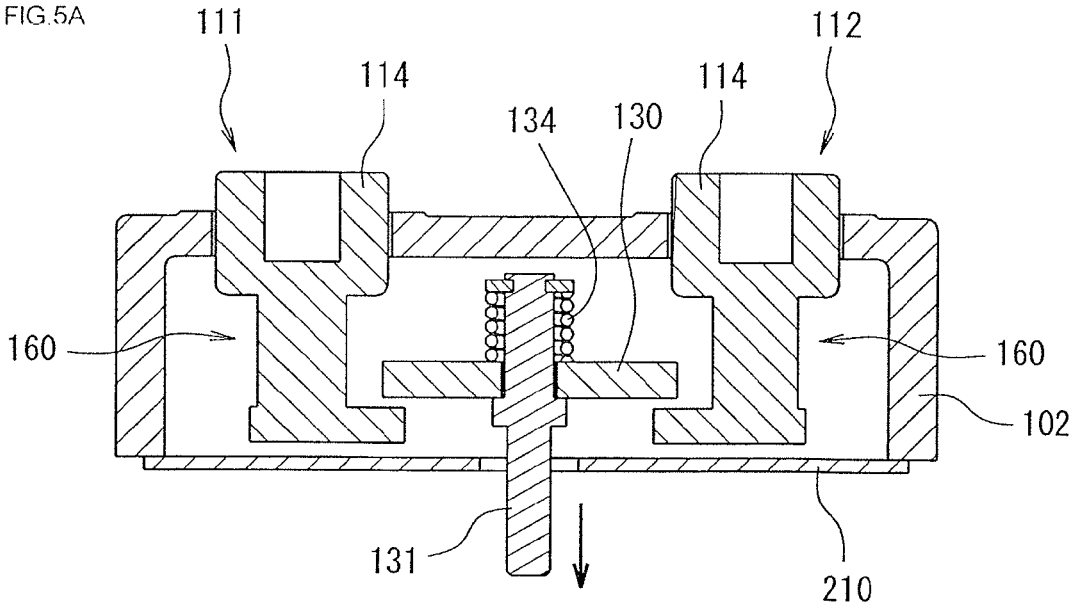
Figure 5B:
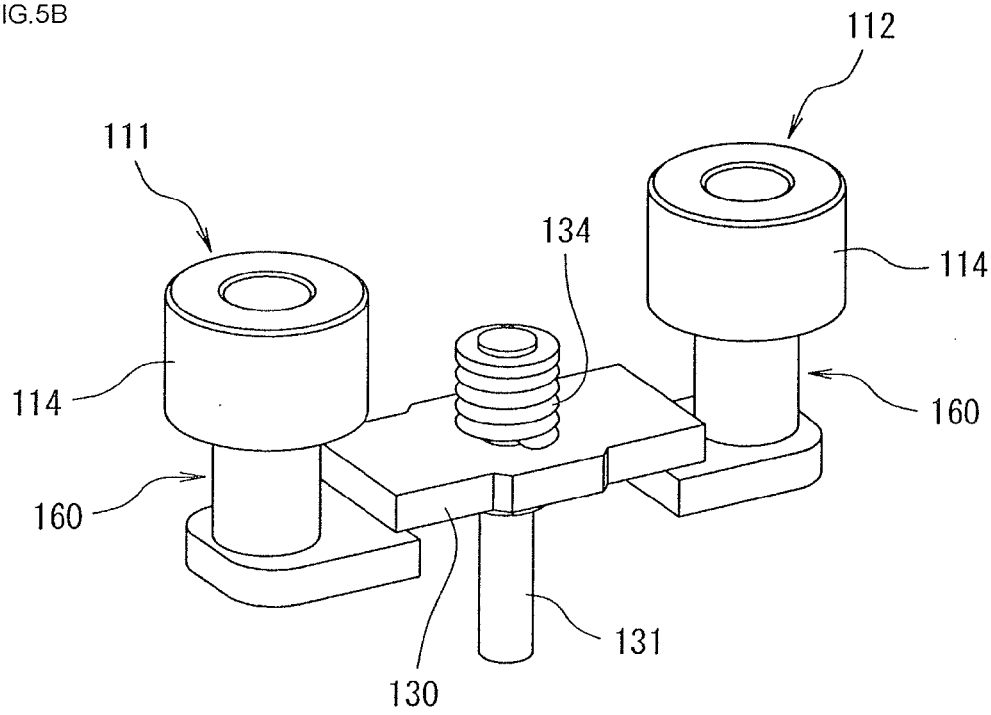

In the construction of the first and second embodiments described above, C-shaped parts 115 are formed in the fixed contact pieces 111 and 112. However, a fixed contact piece 111 (112) can be composed, as shown in FIGS. 5A and 5B, of the support conductor 114 and an L-shaped part 160 that is formed by removing the top plate portion 116 from the C-shaped part 115.

In the closed state having the movable contact piece 130 in contact with the fixed contact pieces 111 and 112, this construction too generates a magnetic flux by the current flowing through the vertical portion of the L-shaped part 160 and this magnetic flux acts at the contact place between the movable contact piece 130 and the fixed contact pieces 111 and 112. This magnetic flux increases the magnetic flux density at the contact place between the movable contact piece 130 and the fixed contact pieces 111 and 112 to generate an enough Lorentz's force to counter the electromagnetic repulsive force.

In the constructions of the first and second embodiments described above, the connecting rod 131 is combined with the movable plunger 215 by screwing them together. However, the movable plunger 215 and the connecting rod 131 can be formed monolithic.

In the above description, the contact housing 102 for the contact mechanism 101 contains an enclosed gas of hydrogen gas, nitrogen gas, mixed gases of hydrogen and nitrogen, air, $SF_6$, or another gas. However, gas enclosure is not necessary if the current flowing through the fixed contact pieces 111 and 112 is low.

What is claimed is:

1. An electromagnetic contactor comprising a contact device including:

a pair of fixed contact pieces arranged with a predetermined gap therebetween;

a movable contact piece disposed to contact with and separate away from the pair of fixed contact pieces;

a contact housing made of an insulating material for housing the pair of fixed contact pieces and the movable contact piece;

a pair of arc-extinguishing inner permanent magnets disposed on inner peripheral surfaces of the contact housing along the movable contact piece; and a pair of arc-extinguishing outer permanent magnets disposed on outer peripheral surfaces of the contact housing at a section facing the arc-extinguishing inner permanent magnets, wherein magnetic pole surfaces of the pair of arc-extinguishing inner permanent magnets are arranged in a close vicinity of the movable contact piece and are magnetized to have same polarity facing each other, and each of the pair of arc-extinguishing outer permanent magnets is magnetized in a same direction as each of the pair of arc-extinguishing inner permanent magnets disposed nearby and coercive force of the pair of arc-extinguishing outer permanent magnets is greater than that of the pair of arc-extinguishing inner permanent magnets.

2. An electromagnetic contactor according to claim 1, wherein each end of the pair of arc-extinguishing outer permanent magnets extends outwardly than each end of the pair of arc-extinguishing inner permanent magnets in a longitudinal direction of the movable contact piece.

3. An electromagnetic contactor according to claim 1, wherein each of the pair of arc-extinguishing outer permanent magnets is divided into two pieces in a longitudinal direction of the movable contact piece.

4. An electromagnetic contactor according to claim 1, wherein each of the pair of arc-extinguishing inner permanent magnets is covered with a magnet case formed on the inner peripheral surface of the contact housing.

5. An electromagnetic contactor according to claim 4, wherein the magnet case includes a guide slidably contacting the movable contact piece and restricting rotation of the movable contact piece.

6. An electromagnetic contactor according to claim 1, further comprising a pair of magnetic yoke, wherein one end portion, in a direction parallel to a longitudinal direction of the movable contact piece, of an outer surface of one of the pair of arc-extinguishing outer permanent magnets is connected to one end portion of an outer surface of the other of the pair of arc-extinguishing outer permanent magnets by one of a pair of magnetic yokes, and the other end portion, in the direction parallel to the longitudinal direction of the movable contact piece, of the outer surface of the one of the pair of arc-extinguishing outer permanent magnets is connected to the other end portion of the outer surface of the other of the pair of arc-extinguishing outer permanent magnet by the other of the pair of magnetic yokes.

* * * * *

UNITED STATES PATENT AND TRADEMARK OFFICE

CERTIFICATE OF CORRECTION

PATENT NO. : 8,760,247 B2
APPLICATION NO. : 13/664580
DATED : June 24, 2014
INVENTOR(S) : Masaharu Isozaki et al.

It is certified that error appears in the above-identified patent and that said Letters Patent is hereby corrected as shown below:

Title Page, item (57), line 17 of abstract, change "than of that the arc-extinguishing inner permanent magnets" to -- than that of the arc-extinguishing inner permanent magnets --

In the Specification

Please change column 5, line 28, "through-hole 120 and a screwing the two together" to -- through-hole 120 and screwing the two together --

Please change column 6, line 40, "118a of the fixed contact piece 112 and the other contact pint" to -- 118a of the fixed contact piece 112 and the other contact point --

Please change column 11, line 37, "flux p is from inside to outside (leftward). According to Flem-" to -- flux φ is from inside to outside (leftward). According to Flem- --

Please change column 13, line 56, "predetermined gap therebetween at the center position, in the" to -- a predetermined gap therebetween at the center position, in the" --

Signed and Sealed this
Eleventh Day of November, 2014

Michelle K. Lee

Michelle K. Lee
*Deputy Director of the United States Patent and Trademark Office*